US009693626B2

(12) United States Patent
Zimmermann

(10) Patent No.: US 9,693,626 B2
(45) Date of Patent: Jul. 4, 2017

(54) DRAWER GUIDE AND METHOD FOR MOUNTING A DRAWER TO A CARCASS

(71) Applicant: Schock Metallwerk GmbH, Urbach (DE)

(72) Inventor: Joachim Zimmermann, Schorndorf (DE)

(73) Assignee: Schock Metallwerk GmbH, Urbach (DE)

( * ) Notice: Subject to any disclaimer, the term of this patent is extended or adjusted under 35 U.S.C. 154(b) by 77 days.

(21) Appl. No.: 14/719,527

(22) Filed: May 22, 2015

(65) Prior Publication Data

US 2015/0250311 A1 Sep. 10, 2015

Related U.S. Application Data

(63) Continuation of application No. 14/098,611, filed on Dec. 6, 2013, now abandoned, which is a continuation (Continued)

(30) Foreign Application Priority Data

Jun. 17, 2011 (DE) ..... 10 2011 051 126

(51) Int. Cl.
*A47B 88/04* (2006.01)
*E05B 65/44* (2006.01)

(Continued)

(52) U.S. Cl.
CPC ..... *A47B 88/04* (2013.01); *A47B 88/40* (2017.01); *A47B 88/427* (2017.01);

(Continued)

(58) Field of Classification Search
CPC ..... A47B 88/04; A47B 88/0466; A47B 88/16; A47B 88/18; A47B 88/0422;

(Continued)

(56) References Cited

U.S. PATENT DOCUMENTS 3,177,047 A 4/1965 Mutchnik et al.
3,771,849 A 11/1973 Barber (Continued)

FOREIGN PATENT DOCUMENTS

DE 22 02 312 10/1973
DE 27 45 281 4/1979

(Continued)

*Primary Examiner* — Ryan J Walters
(74) *Attorney, Agent, or Firm* — Lipsitz & McAllister, LLC

(57) ABSTRACT

A drawer guide is provided for the displaceable arrangement of a drawer, which is arranged to be pulled out from a carcass in a pull-out direction, on the carcass. The drawer guide comprising at least two guide rails, which are displaceable relative to one another with respect to the pull-out direction. A carcass-side guide rail is provided, which is arranged, in an assembled state of the drawer guide, on the carcass. A drawer-side guide rail is provided, which, in the assembled state of the drawer guide, is arranged on the drawer. At least one front end region with respect to the pull-out direction, of the drawer-side guide rail, in a preassembled state of the drawer guide, is movable in a deflection direction running transversely to the pull-out direction relative to the carcass-side guide rail to achieve the assembled state of the drawer guide on the drawer.

11 Claims, 9 Drawing Sheets

Related U.S. Application Data of application No. PCT/EP2012/061111, filed on Jun. 12, 2012.

(51) Int. Cl.

| | |
|---|---|
| ***A47B 88/40*** | (2017.01) |
| ***A47B 88/427*** | (2017.01) |
| ***A47B 88/437*** | (2017.01) |
| ***A47B 88/57*** | (2017.01) |
| ***A47B 88/60*** | (2017.01) |

(52) U.S. Cl.

CPC ..... *A47B 88/437* (2017.01); *A47B 88/57* (2017.01); *A47B 88/60* (2017.01); *E05B 65/44* (2013.01); *A47B 2088/4272* (2017.01); *A47B 2088/4276* (2017.01); *Y10T 29/4984* (2015.01)

(58) Field of Classification Search

CPC .... A47B 2088/0425; A47B 2088/0433; E05B 65/44; Y10T 29/4984

See application file for complete search history.

(56) References Cited

U.S. PATENT DOCUMENTS

| | | | |
|---|---|---|---|
| 3,913,998 | A | 10/1975 | Vander Ley |
| 4,838,627 | A | 6/1989 | Macias |
| 5,632,542 | A | 5/1997 | Krivec |
| 6,076,908 | A | 6/2000 | Maffeo |
| 6,789,861 | B1 | 9/2004 | Dobberstein |
| 6,854,379 | B2 | 2/2005 | Pattle et al. |
| 7,312,990 | B2 | 12/2007 | Mangold |
| 7,316,179 | B2 | 1/2008 | Geberzahn et al. |
| 7,722,139 | B1 | 5/2010 | Chen et al. |
| 7,942,486 | B2 | 5/2011 | Petri |
| 8,708,436 | B2 | 4/2014 | Laible |
| 2003/0079615 | A1 | 5/2003 | Pattle et al. |
| 2004/0003726 | A1 | 1/2004 | Geberzahn et al. |
| 2004/0164654 | A1 | 8/2004 | Laible |
| 2005/0074190 | A1 | 4/2005 | Traiser et al. |
| 2007/0261199 | A1 | 11/2007 | Petri |
| 2010/0019641 | A1 | 1/2010 | Laible et al. |
| 2010/0066224 | A1 | 3/2010 | Placke et al. |
| 2011/0142380 | A1 | 6/2011 | Jeakings |

FOREIGN PATENT DOCUMENTS

| | | |
|---|---|---|
| DE | 31 14 809 | 6/1982 |
| DE | 87 16 434 | 3/1988 |
| DE | 93 14 893 | 3/1994 |
| DE | 100 22 084 | 11/2001 |
| DE | 103 40 482 | 4/2005 |
| DE | 20 2005 013 789 | 12/2005 |
| DE | 10 2005 002 315 | 7/2006 |
| DE | 10 2006 007 978 | 8/2007 |
| DE | 20 2007 007 773 | 10/2007 |
| DE | 20 2008 000 887 | 4/2008 |
| DE | 20 2011 051 895 | 1/2012 |
| DE | 10 2011 004 889 | 9/2012 |
| EP | 0 041 616 | 12/1981 |
| EP | 0 784 950 | 7/1997 |
| EP | 1 225 806 | 4/2004 |
| EP | 1 327 109 | 12/2004 |
| EP | 1 306 622 | 9/2005 |
| EP | 1 243 203 | 8/2006 |
| EP | 1 277 422 | 10/2006 |
| EP | 1 502 521 | 10/2006 |
| EP | 1 571 357 | 8/2007 |
| EP | 1 607 685 | 8/2007 |
| EP | 1 662 159 | 3/2010 |
| EP | 2 160 960 | 3/2010 |
| EP | 1 532 402 | 12/2010 |
| EP | 2 325 565 | 5/2011 |
| EP | 1 642 066 | 10/2011 |
| EP | 2 487 422 | 8/2012 |
| EP | 2 532 273 | 12/2012 |
| EP | 2 532 976 | 12/2012 |
| WO | WO 2006/000523 | 1/2006 |
| WO | WO 2009/150434 | 12/2009 |
| WO | WO 2010/089553 | 8/2010 |
| WO | WO 2012/025717 | 3/2012 |

DRAWER GUIDE AND METHOD FOR MOUNTING A DRAWER TO A CARCASS

RELATED APPLICATION

This application is a continuation of U.S. application Ser. No. 14/098,611 filed on Dec. 6, 2013, which is a continuation of International application No. PCT/EP2012/061111 filed on Jun. 12, 2012 and which claims the benefit of German application number 10 2011 051 126.1 filed on Jun. 17, 2011, each of which are incorporated herein by reference in their entirety and for all purposes.

FIELD OF DISCLOSURE

The present invention relates to a drawer guide for the displaceable arrangement of a drawer, which is configured to be pulled out of a carcass in a pull-out direction, on the carcass, said drawer guide comprising at least two guide rails, which are displaceable relative to one another with respect to the pull-out direction, wherein there are provided a carcass-side guide rail, which, in an assembled state of the drawer guide, is arranged on the carcass, and a drawer-side guide rail, which, in the assembled state of the drawer guide, is arranged on the drawer.

BACKGROUND

To fasten a drawer on the drawer guide, on the one hand, and to fasten the drawer guide on the carcass, on the other hand, screw connections may, for example, be provided.

SUMMARY OF THE INVENTION

The present invention is based on the object of providing a drawer guide of the type mentioned in the introduction that allows easy and reliable assembly of a drawer on a carcass.

This object is achieved according to the invention in that at least one front end region with respect to the pull-out direction, of the drawer-side guide rail, in a preassembled state of the drawer guide, is movable in a deflection direction running transversely to the pull-out direction relative to the carcass-side guide rail to achieve the assembled state of the drawer guide on the drawer.

Since at least one front end region of the drawer-side guide rail is movable in the deflection direction relative to the carcass-side guide rail to achieve the assembled state of the drawer guide, a drawer can be arranged particularly easily on the drawer-side guide rail, in particular latched thereto.

An "assembled state" in this description and the accompanying claims is taken to mean that state in which the drawer guide is connected to a carcass and a drawer in order to displaceably hold the drawer on the carcass.

A "preassembled state" in this description and the accompanying claims is taken to mean that state, in which the individual parts of the drawer guide are assembled to form a functioning drawer guide, but a drawer is not yet arranged on the drawer guide.

It may be favourable if at least one front end region with respect to the pull-out direction, of the drawer-side guide rail, in a preassembled state of the drawer guide, is movable in a deflection direction running substantially perpendicularly to the pull-out direction relative to the carcass-side guide rail to achieve the assembled state of the drawer guide on the drawer.

The front end region of the drawer-side guide rail is the end region of the drawer-side guide rail, which is arranged in front of the carcass-side guide rail in the pulled-out state of the drawer guide, in other words, the end region of the drawer-side guide rail located at the front with respect to the pull-out direction. It may be advantageous if a front end with respect to the pull-out direction, of the drawer-side guide rail is movable by at least about 2 mm, preferably by at least about 5 mm, transversely, in particular perpendicularly, to the pull-out direction.

In one configuration of the invention it is provided that to move the front end region of the drawer-side guide rail in the deflection direction, the drawer-side guide rail, in the preassembled state of the drawer guide, is tiltable relative to the carcass-side guide rail. The movability of the front end region relative to the carcass-side guide rail can thus be made possible particularly easily.

In particular, it may be provided that the drawer-side guide rail in the preassembled state of the drawer guide is tiltable by at least about 1°, preferably by at least about 2°, relative to the carcass-side guide rail relative to the pull-out direction.

It may be favourable if, to move the front end region of the drawer-side guide rail in the deflection direction, the drawer-side guide rail, in the preassembled state of the drawer guide, is tiltable relative to the carcass-side guide rail about a tilting axis running substantially perpendicularly to the pull-out direction.

In particular, it may be provided here that the drawer-side guide rail is tiltable relative to the carcass-side guide rail about an axis predetermined by a bearing region, the bearing region being that region, in which the drawer-side guide rail is mounted on the carcass-side guide rail and/or on a further guide rail of the drawer guide arranged between the drawer-side guide rail and the carcass-side guide rail. In particular, it may be provided here that the drawer-side guide rail is mounted on a further guide rail of the drawer guide and/or on the carcass-side guide rail by means of rolling bodies. A tiltable arrangement of the drawer-side guide rail is, in particular, configured to be realised by a flexible configuration of rolling body tracks for the rolling bodies and/or by a flexible configuration of the rolling bodies themselves and/or by an, in particular lateral, play in the connection between the rolling body tracks and the rolling bodies.

It may be favourable if, in order to move the front end region of the drawer-side guide rail in the deflection direction, the drawer-side guide rail is bendable, at least in the preassembled state of the drawer guide.

In particular, a bendability of the drawer-side guide rail can be taken to mean a bendability resulting from an inherent resilience due to the material of the drawer-side guide rail, of at least a part of the drawer-side guide rail, in particular of the substantially entire drawer-side guide rail.

It may be advantageous if at least one of the at least two guide rails of the drawer guide is substantially C-shaped, a rail back of the at least one guide rail connecting two legs of the at least one guide rail to one another. At least one rolling body track is preferably formed in each case on the legs.

A rolling body track is used as a support face for rolling bodies, by means of which at least two guide rails are preferably arranged on one another. Balls are, for example, provided as rolling bodies and comprise a metallic material, in particular steel and/or plastics material or are substantially completely formed from metal, in particular from steel, or from plastics material. In particular, it may be provided that at least one rolling body is configured as a plastics material-coated or metal-coated metal ball.

Alternatively or in addition to this, for example, cylindrically configured rolling bodies may be provided, which comprise a metallic material, in particular steel, and/or plastics material or are formed substantially completely from metal, in particular from steel, or from plastics material. For example, at least one cylindrical rolling body may be provided, which comprises a cylindrical base body made of metal, which is provided with a plastics material coating or metal coating.

The rolling body tracks are preferably configured in portions substantially in a complementary manner with respect to the rolling bodies, for example as channels running along the pull-out direction with a circular portion-shaped cross-section. In this manner, the rolling bodies can be guided particularly easily in the rolling body tracks.

In one configuration of the invention, it is provided that the front end region of the drawer-side guide rail comprises at least one portion of a rail back of the drawer-side guide rail, which rail back connects two legs of the drawer-side guide rail to one another, on which at least one rolling body track is formed in each case.

It may be favourable if the deflection direction, in the preassembled state of the drawer guide, runs substantially parallel or substantially perpendicularly to a rail plane, along which the rail back of the drawer-side guide rail extends.

Thus, it may, in particular, be provided that in the (pre) assembled state of the drawer guide, the deflection direction runs substantially vertically or substantially horizontally.

The rail plane of the drawer-side guide rail is preferably substantially parallel to the pull-out direction and, in the (pre)assembled state of the drawer guide, at least approximately vertically or horizontally oriented.

The front end region of the drawer-side guide rail preferably comprises at least one portion of at least one rolling body track of the drawer-side guide rail. The front end region of the drawer-side guide rail therefore preferably comprises at least one portion of at least one leg, on which the at least one rolling body track is configured.

In one configuration of the invention it is provided that the front end region of the drawer-side guide rail comprises at least one deflection portion, by means of which a relative movement of the front end region of the drawer-side guide rail relative to the drawer, said relative movement being directed transversely to the deflection direction, is deflectable into a relative movement, which is directed parallel to the deflection direction, of the front end region of the drawer-side guide rail relative to the drawer.

In particular, it can be provided that when a drawer is slid or placed on the drawer-side guide rail, the direction of a relative movement of the front end region of the drawer-side guide rail relative to the drawer is initially, for example, parallel to the pull-out direction (in particular, substantially horizontal in the preassembled state) or perpendicular to the pull-out direction (in particular, substantially vertical in the preassembled state) and is deflectable by means of the at least one deflection portion, so the direction of the further relative movement after a deflection is transverse to the initial relative movement.

It may be advantageous if at least one deflection portion is formed by an oblique face of the drawer-side guide rail running transversely to the pull-out direction.

Thus, it may, in particular, be provided that at least one oblique face is inclined by at least about 20°, preferably by at least about 35°, in particular by about 45°, relative to the pull-out direction. Furthermore, it may be provided that at least one oblique face is inclined by at most about 70°, preferably by at most about 55°, relative to the pull-out direction.

The drawer guide according to the invention is suitable, in particular for use in combination with a carcass and a drawer.

The present invention is therefore based on the further object of providing a drawer device, which comprises at least one drawer guide, a carcass and a drawer to be arranged on the carcass by means of at least one drawer guide, in which easy and reliable assembly of the drawer on the carcass is to be made possible by means of the at least one drawer guide.

This object is achieved according to the invention by the use of at least one drawer guide according to the invention.

The drawer device according to the invention preferably has the features and/or advantages described above in conjunction with the drawer guide according to the invention.

It may be favourable if the drawer device comprises at least one latching device, by means of which the drawer is latchable to at least one drawer guide.

In one configuration of the invention it is provided that the drawer comprises at least one latching element, which is configured to be brought into engagement with at least one latching element of at least one drawer guide to latch the drawer to the at least one drawer guide.

It may be advantageous if at least a part of at least one drawer-side guide rail forms a latching element of the drawer guide. The drawer can thus be particularly easily latched to at least one drawer guide.

In particular, it may be provided that a rail back of at least one drawer-side guide rail of at least one drawer guide forms a latching element of the at least one drawer-side guide rail.

At least one substantially entire drawer-side guide rail preferably forms a latching element of at least one drawer guide.

In one configuration of the invention it is provided that the drawer comprises at least one deflection portion, by means of which a relative movement of at least one front end region of at least one drawer-side guide rail of at least one drawer guide relative to the drawer, which relative movement, during a sliding on, placing on or insertion of the drawer on and/or in at least one drawer-side guide rail of at least one drawer guide is directed transversely to the deflection direction, is deflectable into a relative movement, which is directed parallel to the deflection direction, of the at least one front end region of the at least one drawer-side guide rail of the at least one drawer guide relative to the drawer.

In particular, it may be provided here that the drawer comprises at least one latching element, which is provided with at least one oblique face.

At least one oblique face of at least one latching element of the drawer is preferably inclined by at least about 20°, in particular by at least about 35°, for example by about 45°, relative to the pull-out direction. Alternatively or in addition to this, it may be provided that at least one oblique face of at least one latching element of the drawer is inclined by at most about 70°, in particular by at most about 55°, relative to the pull-out direction.

It may be advantageous if at least one latching element, which has an oblique face, of the drawer cooperates with at least one latching element, which has an oblique face, of at least one drawer guide during the sliding on, placing on or insertion of the drawer on and/or in at least one drawer-side guide rail of at least one drawer guide.

The drawer preferably has at least one support face for placing the drawer on at least one guide rail of at least one drawer guide. The drawer in a state, in which the at least one drawer guide is present in a preassembled state and already arranged on the carcass but not yet connected to the drawer, can thus be placed on the at least one drawer-side guide rail. At least one drawer-side guide rail, in particular two drawer-side guide rails, of two drawer guides arranged on mutually opposing sides of the drawer, are preferably substantially pulled out for this purpose.

It may be favourable if the drawer is configured to be placed on two drawer-side guide rails of two drawer guides and, by displacing the drawer relative to the drawer-side guide rails along the pull-out direction, is latchable to the drawer guides.

It may be advantageous if the drawer device according to the invention comprises two drawer guides according to the invention and during a sliding on, placing on or insertion of the drawer on and/or in the drawer-side guide rails of the drawer guides, the front end regions of the drawer-side guide rails of the two drawer guides are movable away from one another. The drawer can thus be particularly easily latched to the drawer-side guide rails of the drawer guides.

Furthermore, the drawer guide according to the invention and/or the drawer device according to the invention may have the following described features and/or advantages:

In particular when two drawer guides are provided for the displaceable arrangement of a drawer on a carcass and are arranged on mutually opposite sides of the drawer in the assembled state of the drawer device, the drawer can be particularly easily (releaseably) fixed on the drawer guides in that the drawer is placed on the drawer-side guide rails, in other words placed substantially vertically from above on the drawer-side guide rails and/or slid substantially counter to the pull-out direction onto the drawer-side guide rails. The front end regions of the drawer-side guide rails then preferably move away from one another, in other words, the front end regions are widened.

After a deflection of at least one front end region of at least one drawer-side guide rail, the at least one front end region is brought into a non-deflected starting position, preferably by a spring action caused by the material, in particular resulting from an inherent elasticity of the drawer guide.

After a deflection of at least one front end region of at least one drawer-side guide rail and the return of the latter into the starting position, the drawer and the at least one drawer-side guide rail of the at least one drawer guide are preferably connected to one another in such a way that a relative movement of the drawer relative to the at least one drawer-side guide rail is effectively blocked.

A particularly secure connection between the drawer and at least one drawer-side guide rail can be made possible if at least one screw connection, which can be applied, for example, from an inside of the drawer, is provided as an additional securing mechanism.

A latching of the drawer to at least one drawer guide is preferably only a prefixing mechanism. A secure fixing of the drawer on the at least one drawer guide preferably takes place by means of at least one screw connection.

It is favourable if the drawer in the latched state on at least one drawer-side guide rail still abuts with at least one support face on the at least one drawer-side guide rail. This ensures a particularly secure support of the drawer on the at least one drawer guide.

In one configuration of the invention it may be provided that the drawer, in the completely pulled-out state of the drawer guides, is latchable therewith.

However, it may be advantageous if the latching of the drawer to at least one drawer guide is configured to be carried out in a completely inserted state of the at least one drawer guide.

It may be advantageous if the drawer guide comprises at least three guide rails, namely the carcass-side guide rail, the drawer-side guide rail and at least one centre rail arranged between the carcass-side and the drawer-side guide rail. In particular, a full extension drawer can be formed by means of an at least three-rail drawer guide.

The drawer guide, in an alternative configuration may, however, also comprise only two guide rails that are displaceable relative to one another, namely a carcass-side and a drawer-side guide rail, so a partial extension drawer can be formed.

Further features and/or advantages of the invention are the subject of the following description and the graphical view of an embodiment.

BRIEF DESCRIPTION OF THE DRAWINGS

The same or functionally equivalent elements are provided with the same reference numerals in all the figures.

DETAILED DESCRIPTION OF THE DRAWINGS

Figure 1:
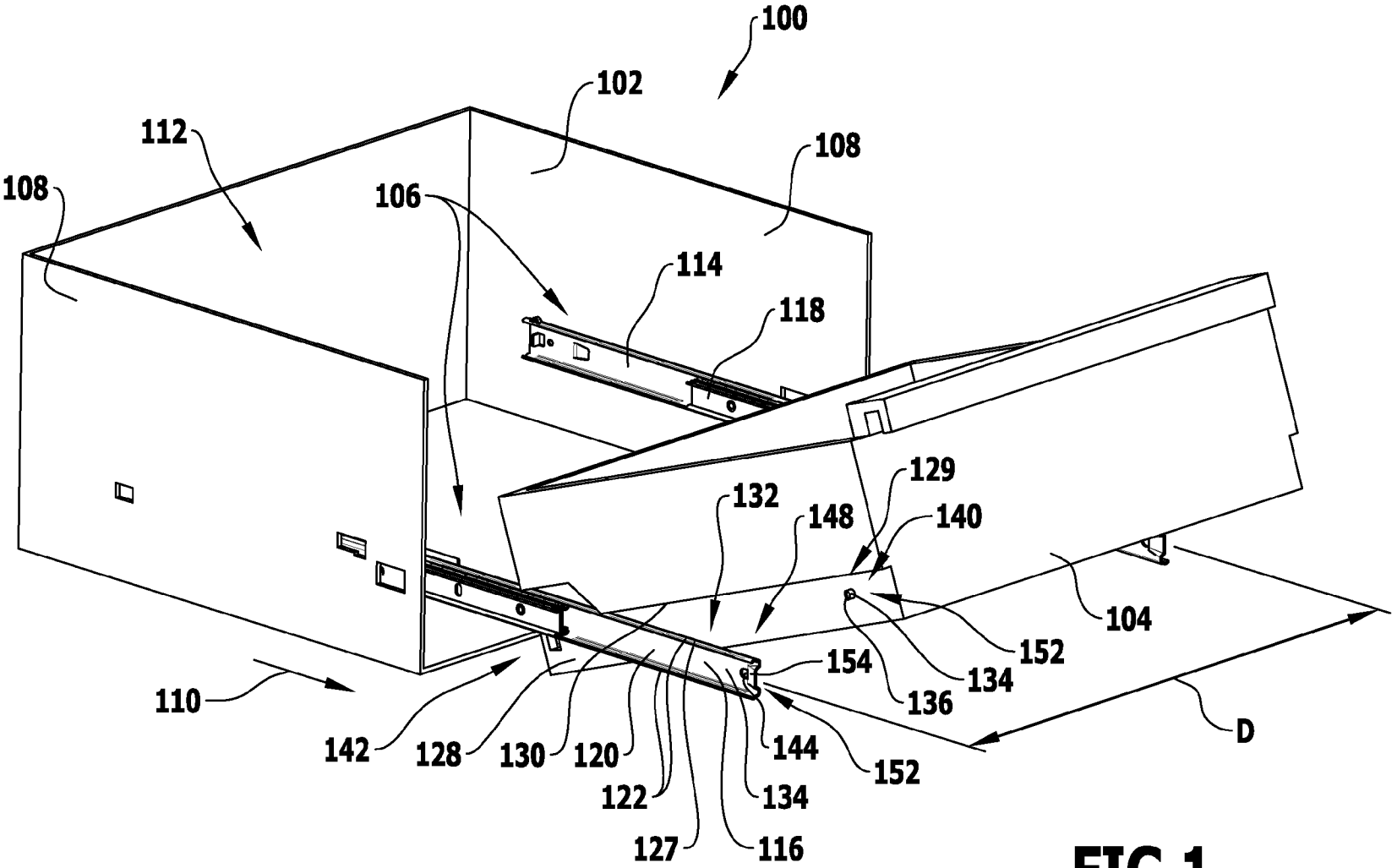
FIG. 1 shows a schematic perspective view of a drawer device, which comprises a carcass, a drawer and two drawer guides for the displaceable arrangement of the drawer on the carcass, the drawer resting loosely on the drawer guides.

A drawer device designated as a whole by 100 and shown in FIGS. 1 to 9 comprises a carcass 102, a drawer 104 and two drawer guides 106, by means of which the drawer 104 is configured to be displaceably arranged on the carcass 102.

The carcass 102 is substantially cuboidal and comprises, in particular, two vertical side walls 108, which, with respect to a pull-out direction 110, in which the drawer 104 is configured to be pulled out of the carcass 102 by means of the drawer guides 106, are arranged on both sides of an interior 112 of the carcass 102 and delimit this interior 112.

A drawer guide 106 is in each case arranged, for example screwed, on the vertical side walls 108.

The drawer guides 106 in each case comprise a carcass-side guide rail 114, which, in the assembled state of the drawer device 100, is arranged on the respective vertical side wall 108 of the carcass 102, a drawer-side guide rail 116, which, in the assembled state of the drawer device 100, is arranged on the drawer 104, and a centre rail 118, by means of which the drawer-side guide rail 116 is displaceably mounted on the carcass-side guide rail 114.

The carcass-side guide rail 114 and the drawer-side guide rail 116 in each case comprise a rail back 120, which connects the two legs 122 to one another. Formed on each of these legs 122 is a rolling body track 124, which is used to receive rolling bodies 126 for the displaceable arrangement of the guide rails 114, 116, 118 on one another.

The rail backs 120, in the assembled state of the drawer device 100, extend along substantially vertically oriented rail planes 121. The legs 122 project away from the rail backs 120 in the substantially horizontal direction.

The rolling body tracks 124 are, in portions, substantially complementary to the rolling bodies 126, configured, for example as balls, and extend along the pull-out direction 110 of the drawer guides 106.

In a preassembled state of the drawer guide 106, in other words in a state, in which the drawer guides 106 are assembled in a functioning manner, and are arranged on the carcass 102 but the drawer 104 is not yet connected to the drawer guides 106, the drawer 104 can be placed on the drawer-side guide rails 116 of the drawer guides 106.

The upper legs 122 with respect to the vertical direction, of the drawer-side guide rails 116 therefore form support faces 127 of the drawer-side guide rails 116, on which the drawer 104 can be placed with support faces 130 of the drawer 104, which are formed, for example, by projections 129 in vertical side walls 128 of the drawer 104.

As can be gathered in particular from FIG. 1, the drawer 104 can thus easily be placed on the drawer-side guide rails 116 of the drawer guide 106 in order to allow an easy arrangement of the drawer 104 on the drawer guides 106, without a fitter of the drawer device 100 having to hold the drawer 104 at a certain height for a relatively long time in order to assemble it on the drawer guides 106.

For the (releasable) arrangement of the drawer 104 on the drawer guides 106, there is provided on the drawer device 100 a latching device 132, which comprises a plurality of latching elements 134, which are configured to be made to engage with one another to latch the drawer 104 to the drawer guides 106.

Provided on the drawer 104 in the vertical side walls 128 of the drawer 104 are latching elements 134, which are formed as latching pins 136 and extend substantially horizontally and perpendicularly with respect to the pull-out direction 110 away from the vertical side walls 128 of the drawer 104, in the assembled state of the drawer device 100.

Figure 4:
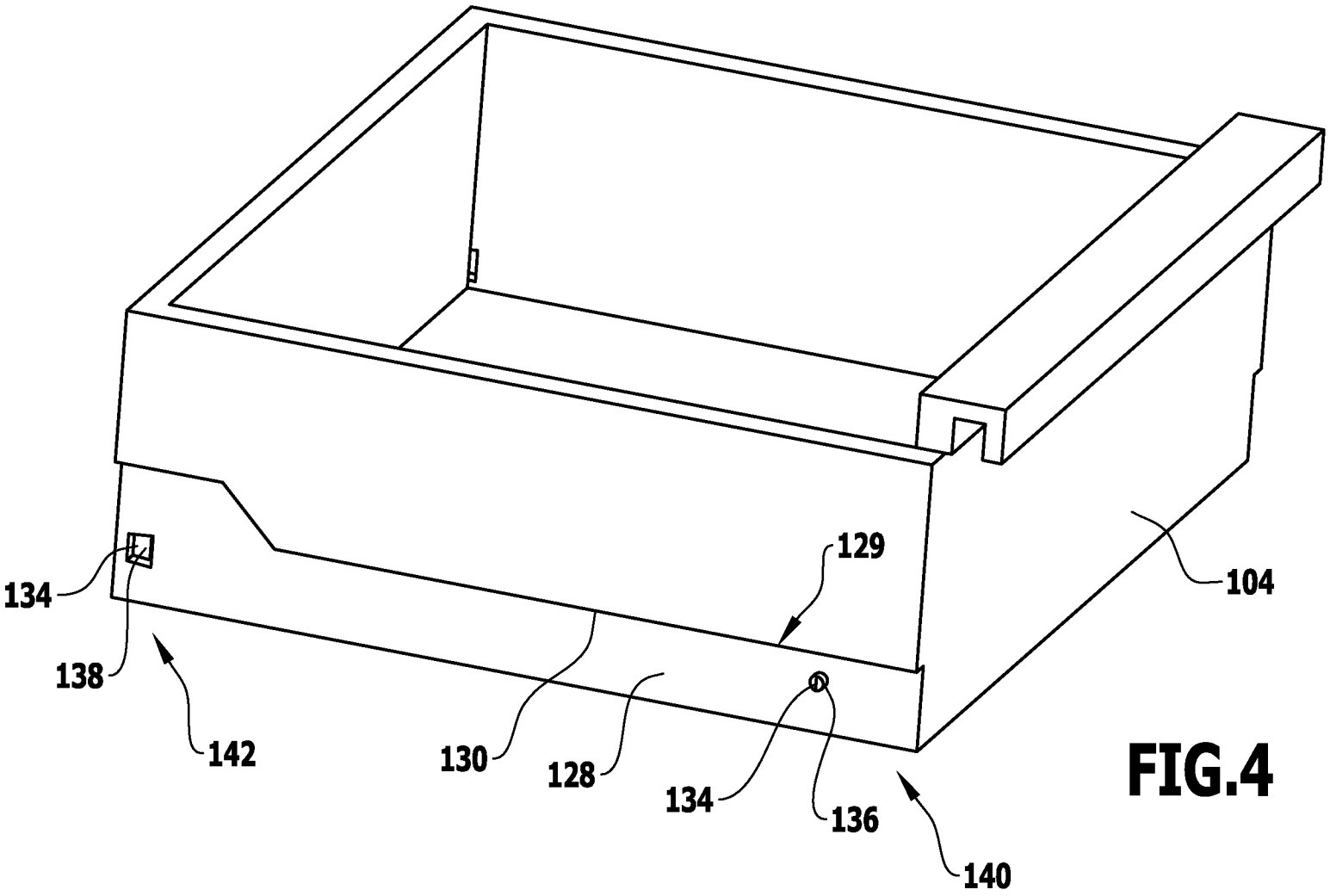
FIG. 4 shows a schematic perspective view of the drawer of the drawer device from FIG. 1.

As is furthermore to be gathered from FIG. 4, the drawer 104 moreover comprises two latching elements 134 formed as latching openings 138.

The latching pins 136 are arranged on a front end region 140 of the drawer 104 with respect to the pull-out direction 110.

The latching openings 138 are arranged on a rear end region 142 of the drawer 104 opposite the front end region 140 with respect to the pull-out direction 110.

Figure 5:
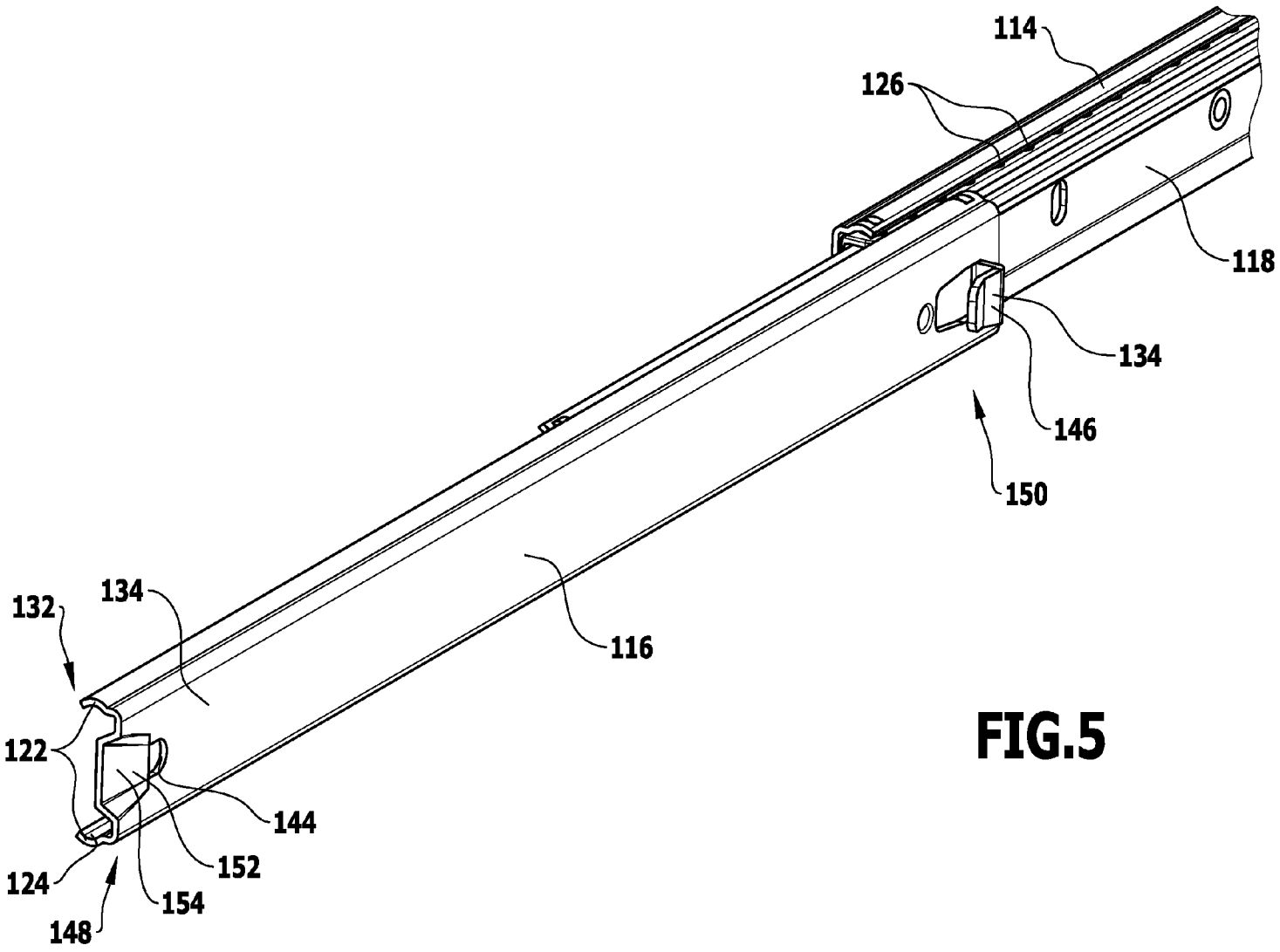
FIG. 5 shows a schematic perspective view of a drawer guide of the drawer device from FIG. 1.
Figure 6:
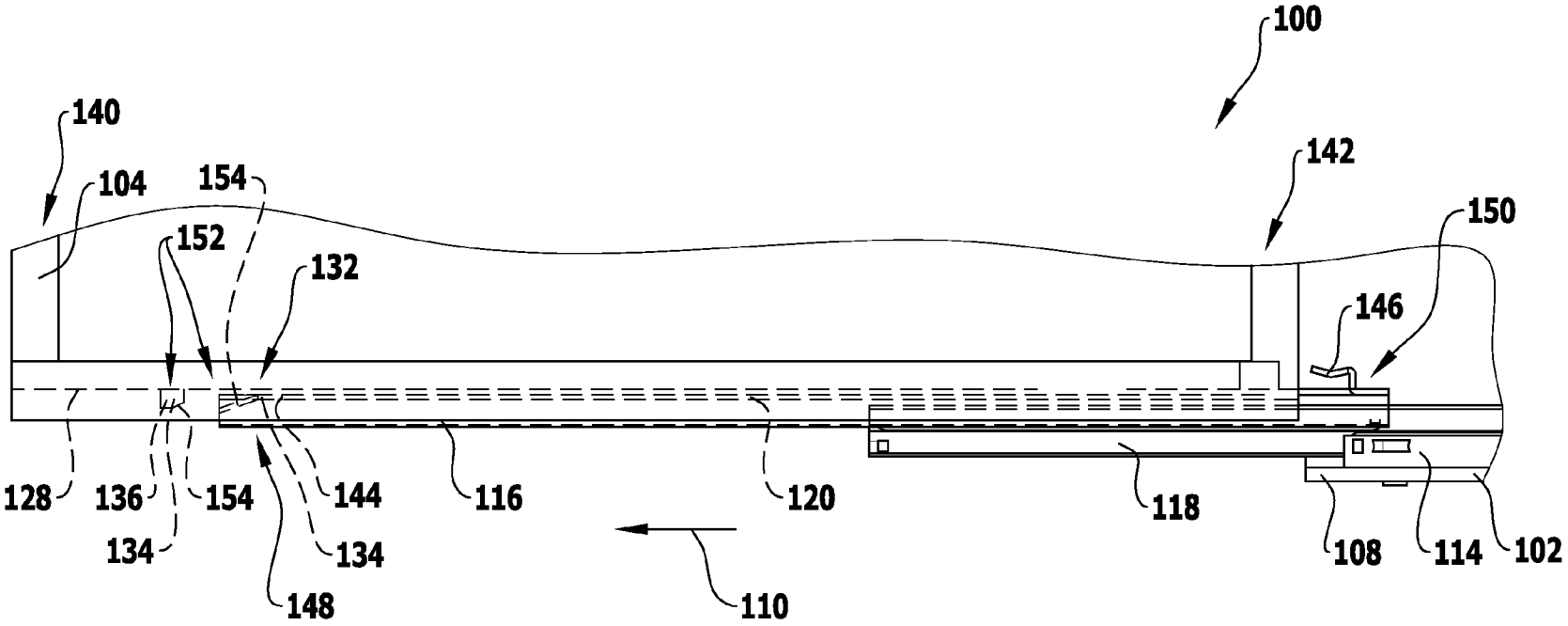
FIG. 6 shows a schematic plan view from above of a drawer-side guide rail of a drawer guide of the drawer device from FIG. 1, the drawer being placed on the drawer-side guide rail.
Figure 7:
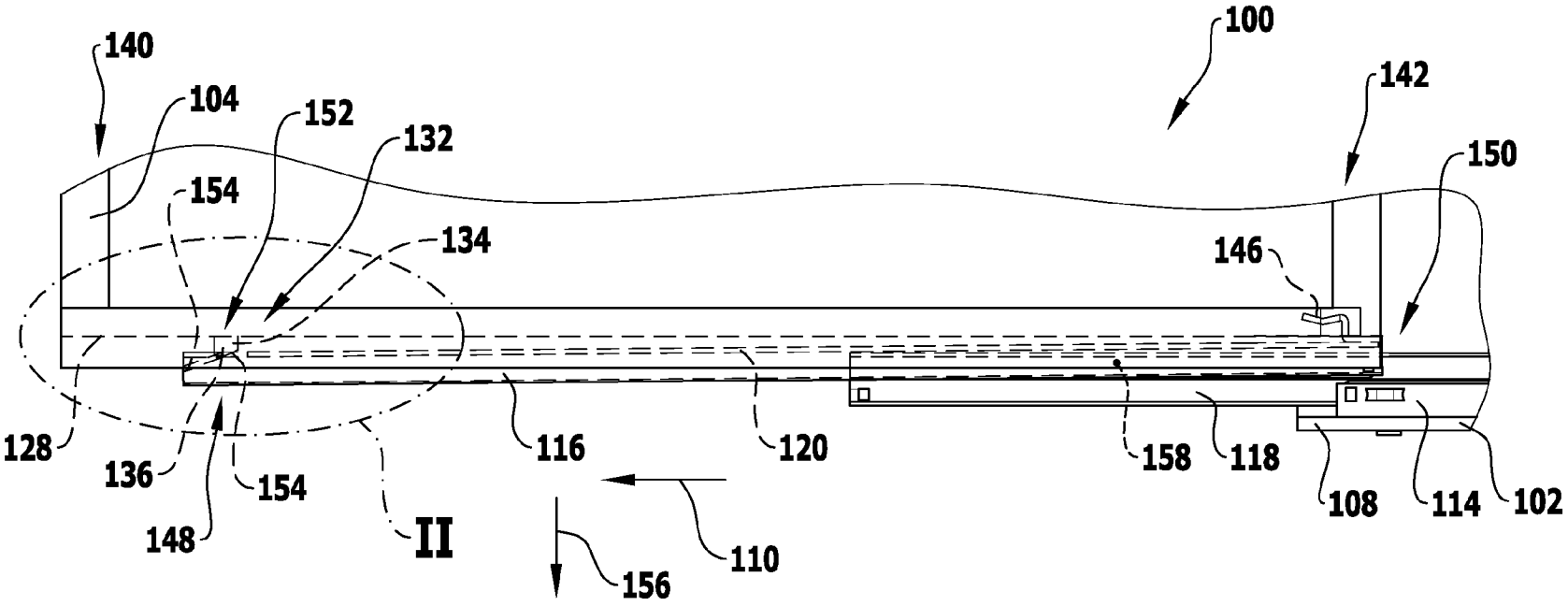
FIG. 7 shows a schematic view of the drawer guide and the drawer, corresponding to FIG. 6, a front end region of the drawer-side guide rail being deflected to latch the latter to the drawer.

In order to latch the drawer 104 to the drawer guides 106, each of the drawer guides 106 is provided, in each case, with a latching element 134 formed as a latching recess 144 and with a latching element 134 formed as a latching hook 146 (see FIG. 5).

The latching recess 144 is arranged here on a front end region 148 of the drawer-side guide rail 116 with respect to the pull-out direction 110.

The latching hook 146 is arranged on a rear end region 150 of the drawer-side guide rail 116 opposite the front end region 148 with respect to the pull-out direction 110.

To latch the drawer 104 to the drawer guides 106, the latching pins 136 of the drawer 104 are configured to be made to engage with the latching recesses 144 of the drawer-side guide rail 116, on the one hand, and the latching openings 138 of the drawer 104 are configured to be made to engage with the latching hooks 146 of the drawer-side guide rail 116, on the other hand.

In the embodiment of the drawer device 100 shown in FIGS. 1 to 9, the latching of the drawer 104 to the drawer guides 106 can easily take place in that the drawer 104 is firstly placed with the support faces 130 of the drawer 104 on the support faces 127 of the drawer-side guide rails 116, wherein the latching pins 136 of the drawer 104 are to be arranged in front of the front end region 148 of the drawer-side guide rail 116 with respect to the pull-out direction 110.

The drawer 104 is then displaceable relative to the drawer-side guide rails 116 with respect to the pull-out direction 110, in particular counter to the pull-out direction 110, in order to make the latching elements 134 of the drawer 104 engage with the latching elements 134 of the drawer-side guide rails 116.

Both the drawer 104 and the drawer-side guide rails 116 of the drawer guides 106 have deflection portions 152, by means of which a relative movement of the drawer-side guide rails 116, in particular the front end regions 148 of the drawer-side guide rails 116, is configured to be influenced relative to the drawer 104.

Thus, in particular, a relative movement of the front end regions 148 of the drawer-side guide rails 116 relative to the drawer 104, which, for example, initially runs along the pull-out direction 110, is deflectable into a movement direction running transversely to the pull-out direction 110 by means of the deflection portions 152 (see in particular FIGS. 6 to 9).

The deflection portions 152 for this purpose comprise oblique faces 154, which are inclined by, for example, 45° relative to the pull-out direction 110.

Both the latching pins and the drawer-side guide rails 116 are provided here with oblique faces 154 of this type, the orientation of the oblique faces 154 being such that upon a movement of the drawer 104 relative to the drawer-side guide rails 116 counter to the pull-out direction 110, the oblique faces 154 of the drawer-side guide rails 116 cooperate with the oblique faces 154 of the drawer 104 and bring about a deflection of the front end regions 148 of the drawer-side guide rails 116 in deflection directions 156 directed transversely to the pull-out direction 110.

Owing to this deflection of the front end regions 148 of the drawer-side guide rails 116, the front end regions 148 of the drawer-side guide rails 116 are lifted from the vertical side walls 128 of the drawer 104, on which the drawer-side guide rails 116 are placed beforehand with the respective rail back 120.

The front end regions 148 of the drawer-side guide rails 116 are consequently moved away from one another by means of the deflection portions 152 of the drawer 104 and the drawer-side guide rails 116, in other words the spacing D between the front end regions 148 of the drawer-side guide rails 116 is increased.

Figure 8:
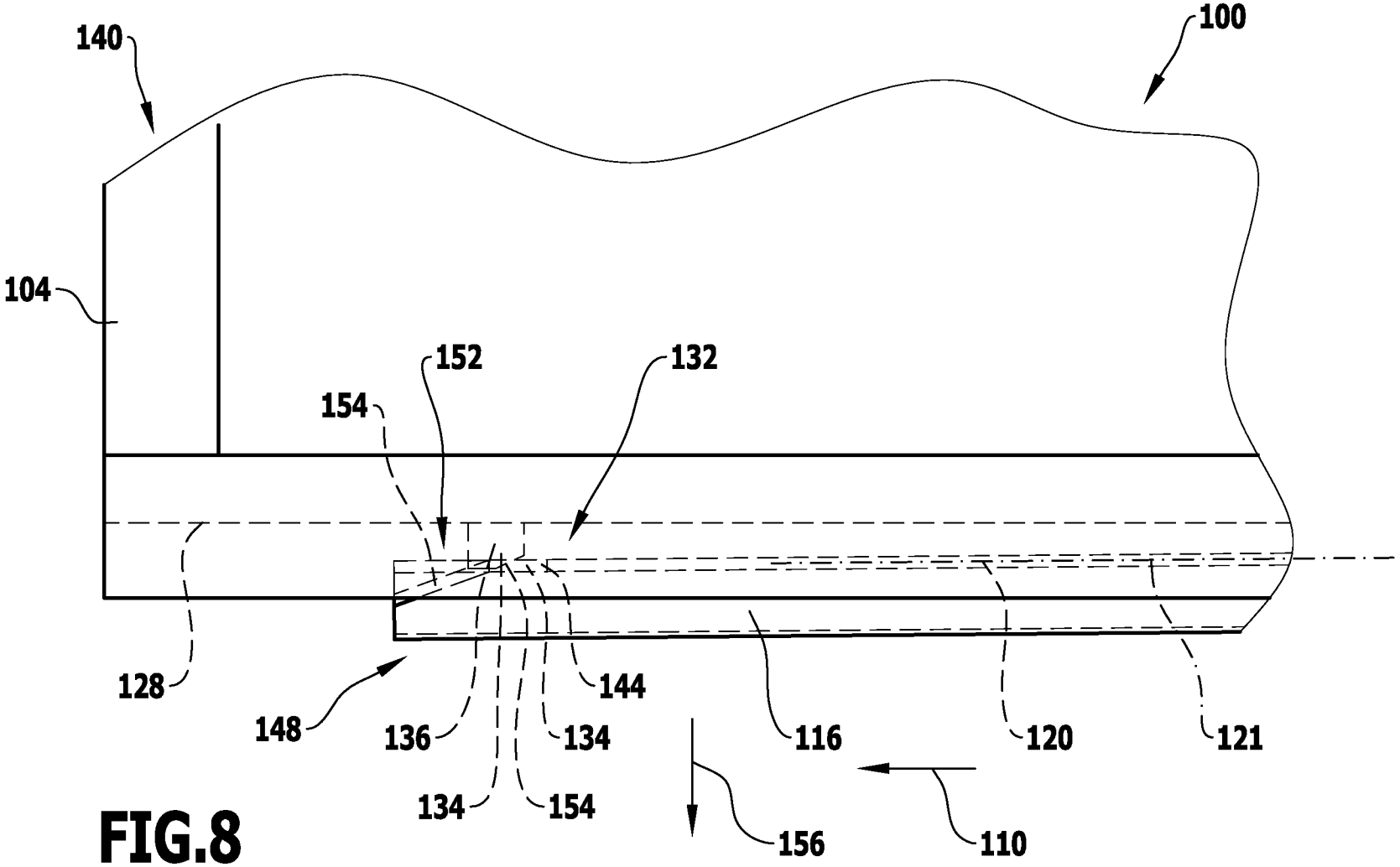
FIG. 8 shows an enlarged view of the region II from FIG. 7.

As can be gathered, in particular from FIG. 8, the front end region 148 of each drawer-side guide rail 116 is deflected here in the deflection direction 156. The drawer-side guide rail 116 is therefore moved not only along the pull-out direction 110 relative to the carcass-side guide rail 114, but also deflected in the horizontal direction perpendicularly to the pull-out direction 110, in other words in the deflection direction 156.

This movement of the front end region 148 of the drawer-side guide rail 116 can, for example, take place in that the drawer-side guide rail 116 is tiltably mounted on the centre rail 118 about a tilting axis 158. The tilting axis 158 is then oriented, for example, perpendicularly to the pull-out direction 110 and substantially vertically. An angle $\alpha$, which is formed by such a tilting of the drawer-side guide rail 116 and the carcass-side guide rail 114, is, for example, at most about 2°.

Such a tilting of the drawer-side guide rail 116 relative to the carcass-side guide rail 114 can, in particular, be made possible by a configuration, which is flexible to at least a small extent, of the rolling bodies 126 and/or of the rolling body tracks 124.

In the fully pulled-out state of the drawer guide 106, the tilting axis 158, because of the arrangement of the rolling bodies 126 on the front end of the centre rail 118 with respect to the pull-out direction 110, is also arranged in the region of the front end of the centre rail 118.

In the fully inserted state of the drawer guide 106, both the rolling bodies 126 and the tilting axis 158 are arranged substantially centrally with respect to the pull-out direction 110 on the centre rail 118 and the drawer-side guide rail 116.

As an alternative or in addition to this, it may be provided that a deflection of the front end regions 148 of the drawer-side guide rails 116 is realised by a bendable configuration of the drawer-side guide rails 116.

It may be advantageous if the deflection of the front end regions 148 of the drawer-side guide rails 116 is a resilient deflection, so the deflection brings about a restoring force, by means of which the front end regions 148 of the drawer-side guide rails 116 can be brought into an original, non-deflected starting position, in which the rail backs 120 of the drawer-side guide rails 116 run substantially parallel to the pull-out direction 110 and, in the assembled state of the drawer device 100, in the substantially vertical direction.

Figure 9:
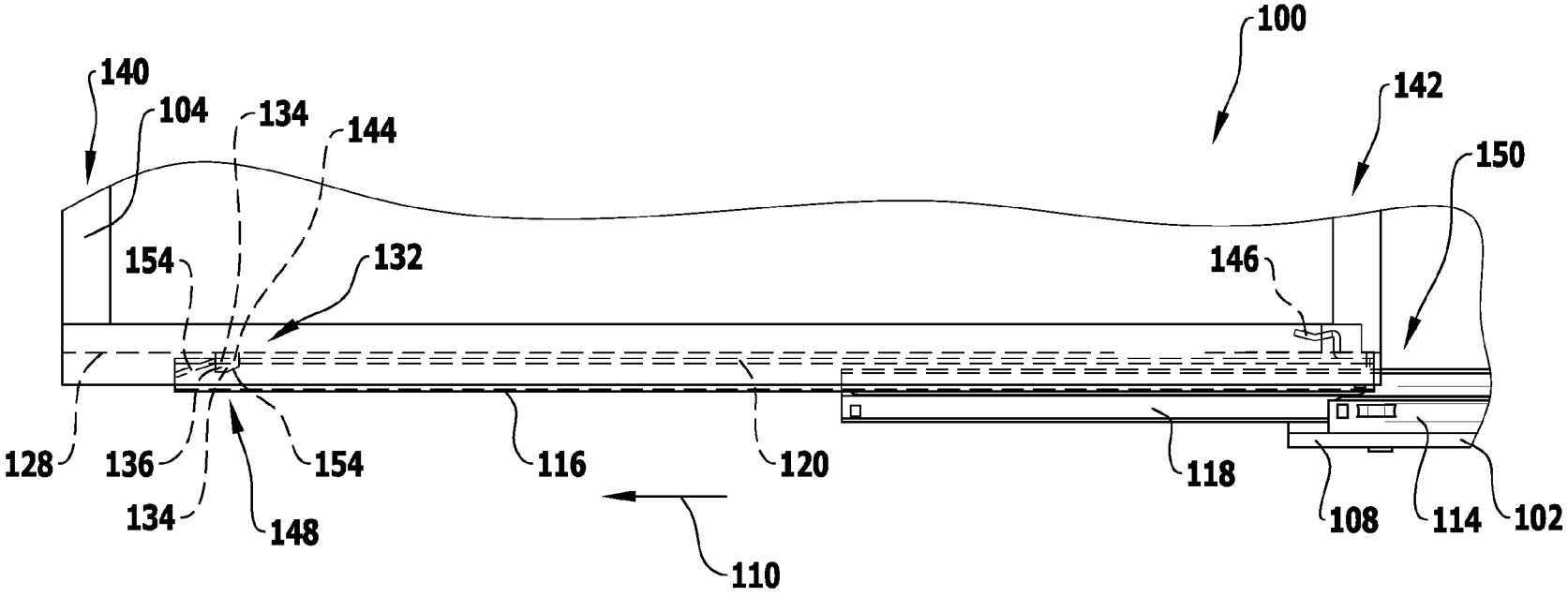
FIG. 9 shows a schematic view of the drawer guide and drawer, corresponding to FIG. 6, the drawer-side guide rail being latched to the drawer.

As can be gathered, in particular from FIG. 9, the deflection of the front end region 148 of a respective drawer-side guide rail 116 is used to engage behind the latching pin 136 of the drawer 104 with respect to the pull-out direction 110 in order to rigidly connect the drawer 104 to the drawer-side guide rails 116.

An additional securing of the drawer 104 takes place in that the latching hooks 146 of the drawer-side guide rails 116 are brought into engagement with the latching openings 138 of the drawer 104.

The above-described drawer device 100 functions as follows: two drawer guides 106 are firstly arranged on the carcass 102. For this purpose, the rail backs 102 of the carcass-side guide rails 114 are rigidly connected, for example screwed, to the vertical side walls 108 of the carcass 102.

The drawer-side guide rails 116 of the drawer guides 106 are then preferably completely pulled out in the pull-out direction 110, so the drawer 104 can be particularly easily placed with the support faces 130 of the drawer 104 on the support faces 127 of the drawer-side guide rails 116.

In this placed-on position of the drawer 104, the latching elements 134, which are formed as latching pins 136, of the drawer 104 are arranged before the front end regions 148 of the drawer-side guide rails 116.

By means of a displacement of the drawer 104 counter to the pull-out direction 110 relative to the drawer-side guide rails 116, the drawer 104 can be latched to the drawer-side guide rails 116 and therefore to the drawer guides 106.

The drawer guides 106 may be stopped for this purpose in the completely pulled-out position. As an alternative to this, it may be provided that the drawer-side guide rails 116 are inserted into the carcass 102 by the movement of the drawer 104 counter to the pull-out direction 110 and a latching only takes place in the completely inserted state of the drawer guides 106.

During the latching, the deflection portions 152 of the drawer 104 are firstly made to engage with the deflection portions 152 of the drawer-side guide rails 116, so the front end regions 148 of the drawer-side guide rails 116 are deflected in the deflection direction 156 and thus the spacing D between the front end regions 148 of the drawer-side guide rails 116 increases.

By means of a further displacement of the drawer 104 counter to the pull-out direction 110 relative to the drawer-side guide rails 116, the latching elements 134 of the drawer 104, which are formed as latching pins 136, are displaced into the region in which the latching recesses 144 are arranged in the drawer-side guide rails 116.

The latching pins 136 of the drawer 104 are then received in the latching recesses 144 and the deflection portions 152 of the drawer 104 and the deflection portions 152 of the drawer-side guide rails 116 disengage from one another, so the front end regions 148 of the drawer-side guide rails 116 are moved back again into the non-deflected position by a restoring force due to the material of the drawer guides 106. The spacing D between the front end regions 148 of the drawer-side guide rails 116 from one another is reduced by this. In this state, the drawer-side guide rails 116 engage behind the latching pins 136, so the drawer 104 can no longer be moved in the pull-out direction 110 relative to the drawer-side guide rail 116.

When the drawer 104 is slid onto the drawer-side guide rails 116 counter to the pull-out direction 110, the latching elements 134, which are formed as latching hooks 146, of the drawer-side guide rails 116, are furthermore made to engage with the latching elements 134, which are formed as latching openings 138, of the drawer 104 in order to ensure an additional securing of the drawer 104.

A further additional securing of the drawer 104 can be realised by the use of a screw connection (not shown) between the drawer 104 and the drawer-side guide rails 116.

Figure 2:
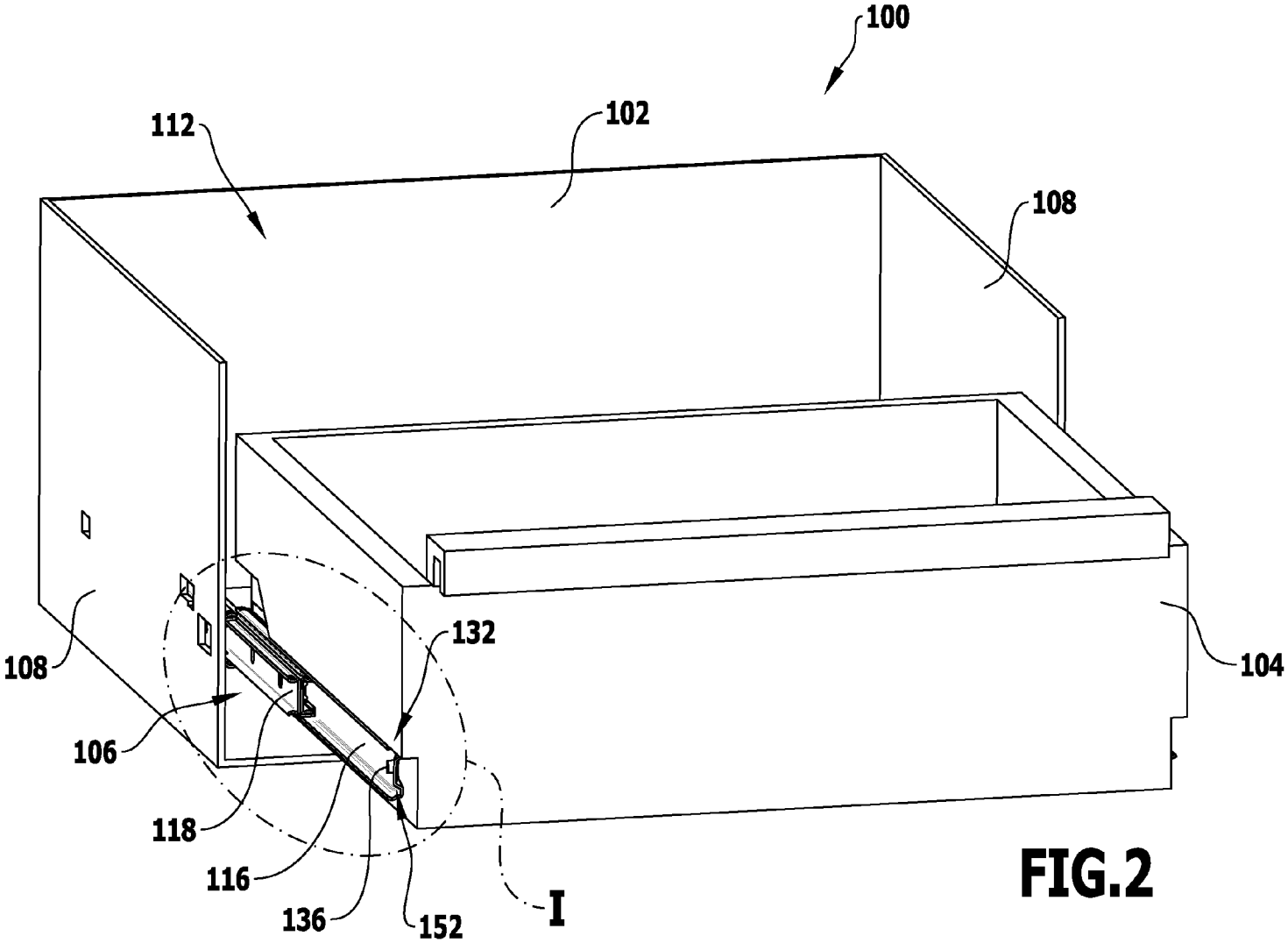
FIG. 2 shows a schematic perspective view of the drawer device from FIG. 1, the drawer being latched to the drawer guides.
Figure 3:
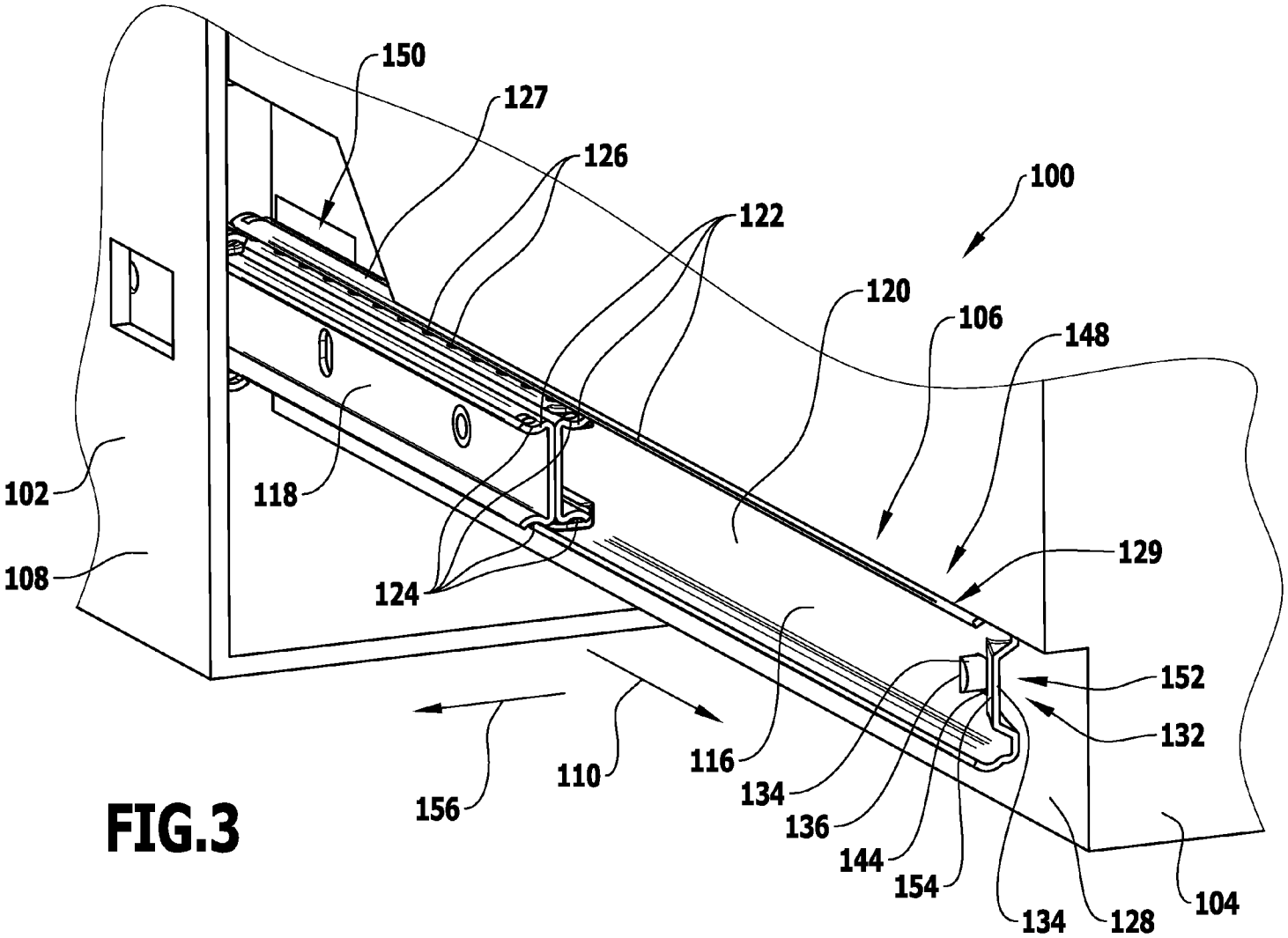
FIG. 3 shows an enlarged view of the region I from FIG. 2.

In the assembled state of the drawer device 100, which is shown, for example, in FIG. 2 and in which the drawer 104 is displaceably arranged on the carcass 102 by means of the drawer guides 106, the drawer 104 can be used to receive items.

By using the drawer guides 106, the drawer 104 can be particularly easily inserted into the carcass 102 and pulled out therefrom, in order for access to be particularly easily gained to the items received in the drawer 104.

Since the front end regions 148 of the drawer-side guide rails 116 are movable relative to the carcass-side guide rails 114 in the deflection direction 156 running transversely to the pull-out direction 110 to achieve the assembled state of the drawer device 100, the drawer 100 can be particularly easily connected to the drawer guides 106.

Other advantageous embodiments are the following:

1. Drawer guide for the displaceable arrangement of a drawer (104), which is configured to be pulled out of a carcass (102) in a pull-out direction (110), on the carcass (102), comprising at least two guide rails (114, 116, 118), which are displaceable relative to one another with respect to the pull-out direction (110), wherein there are provided a carcass-side guide rail (114), which is arranged on the carcass (102) in an assembled state of the drawer guide (106), and a drawer-side guide rail (116), which is arranged on the drawer (104) in the assembled state of the drawer guide (106), characterised in that at least one front end region (148) with respect to the pull-out direction (110), of the drawer-side guide rail (116), in a preassembled state of the drawer guide (106), is movable in a deflection direction (156) running transversely to the pull-out direction (110) relative to the carcass-side guide rail (114) to achieve the assembled state of the drawer guide (106) on the drawer (104).

2. Drawer guide according to embodiment 1, characterised in that the drawer-side guide rail (116), in the preassembled state of the drawer guide (106), is tiltable relative to the carcass-side guide rail (116) to move the front end region (148) of the drawer-side guide rail (116) in the deflection direction (156).

3. Drawer guide according to embodiment 2, characterised in that the drawer-side guide rail (116), in the preassembled state of the drawer guide (106), is tiltable relative to the carcass-side guide rail (116) about a tilting axis (158) running substantially perpendicularly to the pull-out direction (110) to move the front end region (148) of the drawer-side guide rail (116) in the deflection direction (156).

4. Drawer guide according to any one of embodiments 1 to 3, characterised in that the drawer-side guide rail (116), in the preassembled state of the drawer guide (106), is bendable to move the front end region (148) of the drawer-side guide rail (116) in the deflection direction (156).

5. Drawer guide according to any one of embodiments 1 to 4, characterised in that the front end region (148) of the drawer-side guide rail (116) comprises at least a portion of a rail back (120) of the drawer-side guide rail (116), which rail back connects two legs (122) of the drawer-side guide rail (116) to one another, on which at least one rolling body track (124) is configured in each case.

6. Drawer guide according to embodiment 5, characterised in that the deflection direction (156), in the preassembled state of the drawer guide (106), runs substantially parallel or substantially perpendicularly to a rail plane (121), along which the rail back (120) of the drawer-side guide rail (116) extends.

7. Drawer guide according to any one of embodiments 1 to 6, characterised in that the front end region (148) of the drawer-side guide rail (116) comprises at least one portion of at least one rolling body track (124) of the drawer-side guide rail (116).

8. Drawer guide according to any one of embodiments 1 to 7, characterised in that the front end region (148) of the drawer-side guide rail (116) comprises at least one deflection portion (152), by means of which a relative movement of the front end region (148) of the drawer-side guide rail (116) relative to the drawer (104), said relative movement being directed transversely to the deflection direction (156), is deflectable into a relative movement, which is directed parallel to the deflection direction (156), of the front end region (148) of the drawer-side guide rail (116) relative to the drawer (104).

9. Drawer guide according to embodiment 8, characterised in that at least one deflection portion (152) is formed by an oblique face (154), which runs transversely to the pull-out direction (110), of the drawer-side guide rail (116).

10. Drawer device, comprising a drawer (104), which is configured to be pulled out in a pull-out direction (110) from a carcass (102), and at least one drawer guide (106) according to any one of embodiments 1 to 9.

11. Drawer device according to embodiment 10, characterised in that the drawer (104) comprises at least one latching element (134), which is configured to be brought into engagement with at least one latching element (134) of at least one drawer guide (106) to latch the drawer (104) to the at least one drawer guide (106).

12. Drawer device according to embodiment 11, characterised in that at least a part of at least one drawer-side guide rail (116) forms a latching element (134) of the drawer guide (106).

13. Drawer device according to any one of embodiments 10 to 12, characterised in that the drawer (104) comprises at least one deflection portion (152), by means of which a relative movement of at least one front end region (148) of at least one drawer-side guide rail (116) of at least one drawer guide (106) relative to the drawer (104), which relative movement, during a sliding on, placing on or insertion of the drawer (104) on and/or in at least one drawer-side guide rail (116) of at least one drawer guide (106) is directed transversely to the deflection direction (156), is deflectable into a relative movement, which is directed parallel to the deflection direction (156), of the at least one front end region (148) of the at least one drawer-side guide rail (116) of the at least one drawer guide (106) relative to the drawer (104).

14. Drawer device according to any one of embodiments 10 to 13, characterised in that the drawer (104) has at least one support face (130) for placing the drawer (104) on at least one guide rail (114, 116) of at least one drawer guide (106).

15. Drawer device according to any one of embodiments 10 to 14, characterised in that the drawer device (100) comprises two drawer guides (106) according to any one of embodiments 1 to 9 and in that during a sliding on, placing on or insertion of the drawer (104) on and/or in the drawer-side guide rails (116) of the drawer guides (106), the front end regions (148) of the drawer-side guide rails (116) of the two drawer guides (106) are movable away from one another.

What is claimed is:

1. A method for mounting a drawer to a drawer guide for displaceable arrangement of the drawer on a carcass, comprising:

arranging at least one drawer guide comprising at least one carcass-side guide rail and at least one corresponding drawer-side guide rail on the carcass, the at least one carcass-side guide rail and the at least one drawer-side guide rail being displaceable relative to one another with respect to a pull-out direction of the drawer in an assembled state of the at least one drawer guide, and deflecting, by means of a deflection portion, an initial relative movement of a front end region of the at least one drawer-side guide rail relative to the drawer during connection of the drawer to the at least one drawer-side guide rail, which initial relative movement is parallel to the pull-out direction, into a deflection direction, wherein:

the front end region comprises an end region of the at least one drawer-side guide rail with respect to the pull-out direction;

the deflection portion is arranged at the front end region of the at least one drawer-side guide rail, such that, in a preassembled state of the drawer guide, the front end region of the at least one drawer-side guide rail is movable in the deflection direction, the deflection direction runs transversely to the pull-out direction relative to the at least one carcass-side guide rail to achieve the assembled state of the drawer guide on the drawer, the deflection portion comprises at least a portion of a rail back of the at least one drawer-side guide rail, which rail back connects two legs of the at least one drawer-side guide rail to one another, and at least one rolling body track is configured on each of the two legs.

2. The method according to claim 1, wherein the at least one drawer-side guide rail, in the preassembled state of the drawer guide, is tiltable relative to the at least one carcass-side guide rail to move the front end region of the at least one drawer-side guide rail in the deflection direction.

3. The method according to claim 1, wherein the at least one drawer-side guide rail, in the preassembled state of the drawer guide, is tiltable relative to the at least one carcass-side guide rail about a tilting axis running substantially perpendicularly to the pull-out direction to move the front end region of the at least one drawer-side guide rail in the deflection direction.

4. The method according to claim 1, wherein the at least one drawer-side guide rail, in the preassembled state of the drawer guide, is bendable to move the front end region of the at least one drawer-side guide rail in the deflection direction.

5. The method according to claim 1, wherein the deflection direction, in the preassembled state of the drawer guide, runs substantially parallel or substantially perpendicularly to a rail plane, along which the rail back of the at least one drawer-side guide rail extends.

6. The method according to claim 1, wherein the front end region of the at least one drawer-side guide rail comprises at least one portion of at least one rolling body track of the at least one drawer-side guide rail.

7. The method according to claim 1, wherein the deflection portion is formed by an oblique face, which runs transversely to the pull-out direction, of the at least one drawer-side guide rail.

8. The method according to claim 1, wherein the drawer comprises at least one latching element, which is configured to be brought into engagement with at least one latching element of the at least one drawer guide to latch the drawer to the at least one drawer guide.

9. The method according to claim 8, wherein at least a part of the at least one drawer-side guide rail forms the at least one latching element of the at least one drawer guide.

10. The method according to claim 1, wherein the drawer has at least one support face for placing the drawer on the at least one drawer-side guide rail of the at least one drawer guide.

11. The method according to claim 1, wherein:

the at least one drawer guide comprises two drawer guides, each of the two drawer guides comprising one of the at least one drawer-side guide rails and of the at least one carcass-side guide rails, and during a sliding on, placing on or insertion of the drawer on or in the drawer-side guide rails of the drawer guides, the front end regions of the drawer-side guide rails of the two drawer guides are movable away from one another.

* * * * *